US009212497B2

(12) United States Patent
Chlapaty

(10) Patent No.: US 9,212,497 B2
(45) Date of Patent: Dec. 15, 2015

(54) PORTABLE AND COLLAPSIBLE POOL CHAIR

(71) Applicant: Keith Chlapaty, Ostrander, OH (US)

(72) Inventor: Keith Chlapaty, Ostrander, OH (US)

(73) Assignee: Unit Ten, LLC, Ostrander, OH (US)

( * ) Notice: Subject to any disclaimer, the term of this patent is extended or adjusted under 35 U.S.C. 154(b) by 189 days.

(21) Appl. No.: 13/913,430

(22) Filed: Jun. 8, 2013

(65) Prior Publication Data

US 2014/0359930 A1 Dec. 11, 2014

(51) Int. Cl.

| | |
|---|---|
| ***A47C 15/00*** | (2006.01) |
| ***E04H 4/14*** | (2006.01) |
| ***A47C 4/28*** | (2006.01) |

(52) U.S. Cl.

CPC .. *E04H 4/14* (2013.01); *A47C 4/28* (2013.01); *A47C 4/286* (2013.01); *A47C 15/004* (2013.01)

(58) Field of Classification Search

CPC . A61G 7/1005; A61G 7/1059; A61G 7/1074; A61G 7/1076; A47K 3/282; A47K 3/122; A47K 3/12; A47K 3/125; A47C 4/28; A47C 4/286; A47C 4/00; A47C 4/022; A47C 4/02; A47C 5/04; A47C 5/06; A47C 5/10; A47C 1/023; A47D 1/103; A47D 1/02

USPC ..... 4/496, 578.1, 579, 611; 297/255, 16.1, 297/440.24, 452.4, 42

See application file for complete search history.

(56) References Cited

U.S. PATENT DOCUMENTS

| | | | | | |
|---|---|---|---|---|---|
| 1,371,715 | A | * | 3/1921 | West | 248/244 |
| 2,142,263 | A | * | 1/1939 | Bentz | 4/579 |
| 2,142,434 | A | * | 1/1939 | Bentz | 4/579 |
| 2,497,412 | A | * | 2/1950 | Larin | 297/14 |
| 2,624,394 | A | * | 1/1953 | De Milto | 297/352 |
| 3,288,502 | A | * | 11/1966 | Romay | 403/78 |
| 3,971,592 | A | * | 7/1976 | Farley | 297/448.2 |
| 4,221,008 | A | | 9/1980 | Nolan | |
| 4,837,869 | A | | 6/1989 | Simmon | |
| 4,850,282 | A | * | 7/1989 | Postic | 108/47 |
| 4,889,383 | A | * | 12/1989 | Jones | 297/16.1 |
| 4,893,363 | A | * | 1/1990 | Huff | 4/496 |
| 5,058,949 | A | * | 10/1991 | Von Hoffman | 297/45 |
| 5,307,527 | A | | 5/1994 | Schober | |
| 5,333,322 | A | | 8/1994 | Weir | |
| D351,740 | S | | 10/1994 | Tesmer | |
| 5,415,455 | A | * | 5/1995 | Geldbaugh | 297/45 |
| 5,498,054 | A | * | 3/1996 | Tomlinson | 297/16.2 |
| 5,580,130 | A | * | 12/1996 | Williams et al. | 297/352 |
| 5,857,226 | A | | 1/1999 | Sommer | |
| D406,474 | S | * | 3/1999 | Toledo et al. | D6/362 |
| 5,950,256 | A | | 9/1999 | Slater | |
| 6,045,423 | A | | 4/2000 | Silvia | |
| 6,089,651 | A | * | 7/2000 | Carmen | 297/16.1 |

(Continued)

OTHER PUBLICATIONS

CEMI, on line catalog, Therapeutic Seats, http://www.cemi.it/page_details.aspx?language=en&id=101&page=Accessori.

(Continued)

*Primary Examiner* — Lauren Crane
*Assistant Examiner* — Erin Deery
(74) *Attorney, Agent, or Firm* — Standley Law Group LLP

(57) ABSTRACT

A collapsible portable pool chair is provided that can adapt to a pool wall and enable a user to be partially submerged while in a stable, upright position. The pool chair comprises a pool wall attachment assembly and a seat assembly pivotally connected to each other.

11 Claims, 13 Drawing Sheets

(56) References Cited

U.S. PATENT DOCUMENTS

| | | | | |
|---|---|---|---|---|
| 6,179,759 | B1 * | 1/2001 | Tellone | 482/111 |
| 6,311,343 | B1 * | 11/2001 | Wisniewski | 4/496 |
| 6,637,045 | B1 | 10/2003 | Larsen | |
| 6,739,643 | B1 * | 5/2004 | Rock et al. | 296/64 |
| 6,783,181 | B2 | 8/2004 | Scheurer | |
| 7,316,452 | B2 * | 1/2008 | Vestweber | 297/252 |
| 8,240,760 | B2 | 8/2012 | Scheurer | |
| 8,783,765 | B1 * | 7/2014 | Matus et al. | 297/152 |
| 2008/0092285 | A1 | 4/2008 | Petersen | |
| 2008/0093895 | A1 | 4/2008 | Deckert | |
| 2011/0099708 | A1 | 5/2011 | Freedman | |
| 2013/0031712 | A1 | 2/2013 | Gossett | |

OTHER PUBLICATIONS

Sprint Aquatics, on line catalog, Pool Side Chair, http://www.sprintaquatics.com.

* cited by examiner

PORTABLE AND COLLAPSIBLE POOL CHAIR

BACKGROUND

The present invention pertains to swimming pool accessories and, in particular, an aquatic chair that can be utilized for use in a swimming pool, spa, or other aquatic body.

People frequently utilize aquatic bodies or swimming pools as a form of water-based recreation, exercise, relaxation, and therapeutic enjoyment. Pools can be found at many health clubs, fitness centers, private clubs, and residential homes. It is estimated that within the United States there are approximately 11 Million public and private pools.

In order to enhance their swimming pool experience, many swimmers will utilize an aquatic pool accessory. There is a vast array of aquatic pool accessories. Floatation devices, for instance, such as inflatable rafts and floating chairs enable a user to sit and float freely on the water with his or her body partially submerged. Swimming pool aquatic chairs enable users to sit in a more upright and fixed position while still being submerged in the water; these chairs also allow the user's head and/or torso to remain above the water surface. Moreover, some of these aquatic chairs utilize the actual pool structure itself by hanging on the pool wall as a means to support the aquatic chair in an operable position. These aquatic chairs tend to be bulky, and they are often permanently or securely affixed to the side and deck of the pool.

Most swimmers prefer to minimize the effort involved with the preparation and transportation to and from an enjoyable time at the pool—particularly if the user is older or has a physical disability. Swimmers desire aquatic accessories that are lightweight and that are easy to store, setup, and utilize. Aquatic accessories that tend to be cumbersome, heavy, unreliable and difficult to set up are typically left behind. Aquatic wall chairs can be particularly awkward, uncooperative, and difficult to properly attach. Moreover they can be a challenge to adjust for user size and desired seat depth desired by the user.

The present invention provides an apparatus for reducing these problems. The difficulties inherent in the art are therefore overcome in a way which is simple, user friendly, and efficient—which will provide better and more advantageous results.

SUMMARY

For the foregoing reasons, what is needed is to provide an aquatic chair that utilizes an existing pool structure, such as a pool wall that is simple, durable, collapsible, and adjustable—making it easy to utilize, transport, and store for all user ages and abilities.

In accordance with the invention, a collapsible portable pool chair is provided that can adapt to a pool wall and enable a user to be partially submerged while in a stable, upright position. The pool chair comprises a pool wall attachment assembly and a seat assembly pivotally connected to each other; this setup allows the pool chair to collapse and fold up into a compact flat configuration for a reduced profile during transportation and storage.

In a version of the invention, the pool wall attachment assembly includes a pair of length-adjustable vertical support members having top and bottom ends; a length-adjustable cross member attaching the bottom ends of the vertical support members; and a pair of corresponding pool deck support hooks attached near the top end of each vertical support member.

The seat assembly comprises a pair of horizontal support members with proximal and distal ends. The proximal ends of the horizontal support members are pivotally attached to the wall attachment assembly. Preferably, the horizontal support members are pivotally attached near the ends of the length-adjustable cross member. The seat assembly further comprises a length-adjustable front cross member, connecting the front distal ends of the horizontal support members forming a seat perimeter. A seat is located within the seat assembly. The seat assembly further comprises a pair of wall contact support members that are attached near the proximal end of each horizontal support member for adapting to a pool wall.

In a version, the seat is preferably made of a flexible and porous material and is attached between the horizontal support members. The seat can be made of an elastic material as well.

In another version, the pool deck support hooks can be rotatable about the longitudinal axis of the length-adjustable vertical support members, and the wall contact support members can be rotatable about the longitudinal axis of the pair of horizontal support members. This setup would thus allow the support hooks and wall contact support members to rotate inward while the aquatic chair is not in use, providing a reduced presence and easier transport and storage capability.

In a version of the invention, the length-adjustable vertical support members are made of telescoping inner and outer tubular members, wherein the outer tube slides over the inner tube depending on the user desired aquatic chair seat depth. The length can be locked into place by a locking means, potentially by utilizing one or more embedded button clips.

In another version, the length-adjustable cross member and the length-adjustable front cross member comprise a telescoping inner tubular member and an outer tubular member, wherein the outer tubular member slides over the inner tubular member depending on the users desired width of the pool chair. The width can be locked into place by a locking means such as one or more button clips. This enables a user to adjust the width to his or her body size and provides the ability for the chair to collapse for transport and storage of the aquatic chair.

In yet another version, the length-adjustable cross member and the length-adjustable front cross member have two distinct position, an open position wherein the length of the members are maximized for use of the chair and a closed position, wherein the length is minimized for transport and storage. Each position is locked into place by a locking means such as one or more button clips.

The aquatic chair assembly can be made adaptable to any size pool and/or aquatic body.

Still other benefits and advantages of the invention will become apparent to those skilled in the art to which it pertains upon a reading and understanding of the following detailed specification.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
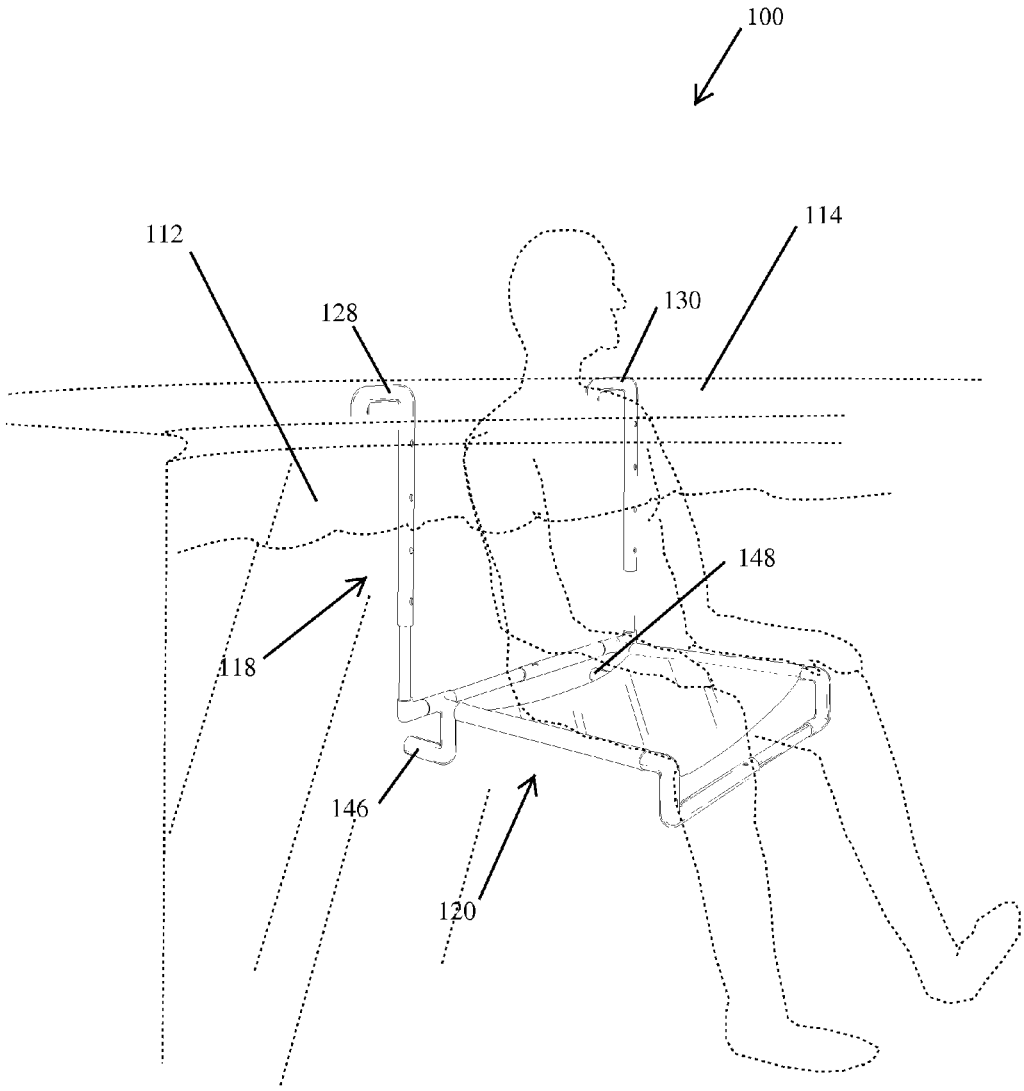
FIG. 1 is a perspective view of an exemplary use of a version of the present invention.

Referring now to the drawings wherein the showings are only for purposes of illustrating a preferred version of the invention and not for purposes of limiting the same.

The following detailed description is of the best currently contemplated modes of carrying out exemplary versions of the invention. The description is not to be taken in the limiting sense, but is made merely for the purpose of illustrating the general principles of the invention, since the scope of the invention is best defined by the appended claims.

Various inventive features are described below that can each be used independently of one another or in combination with other features.

Figure 2A:
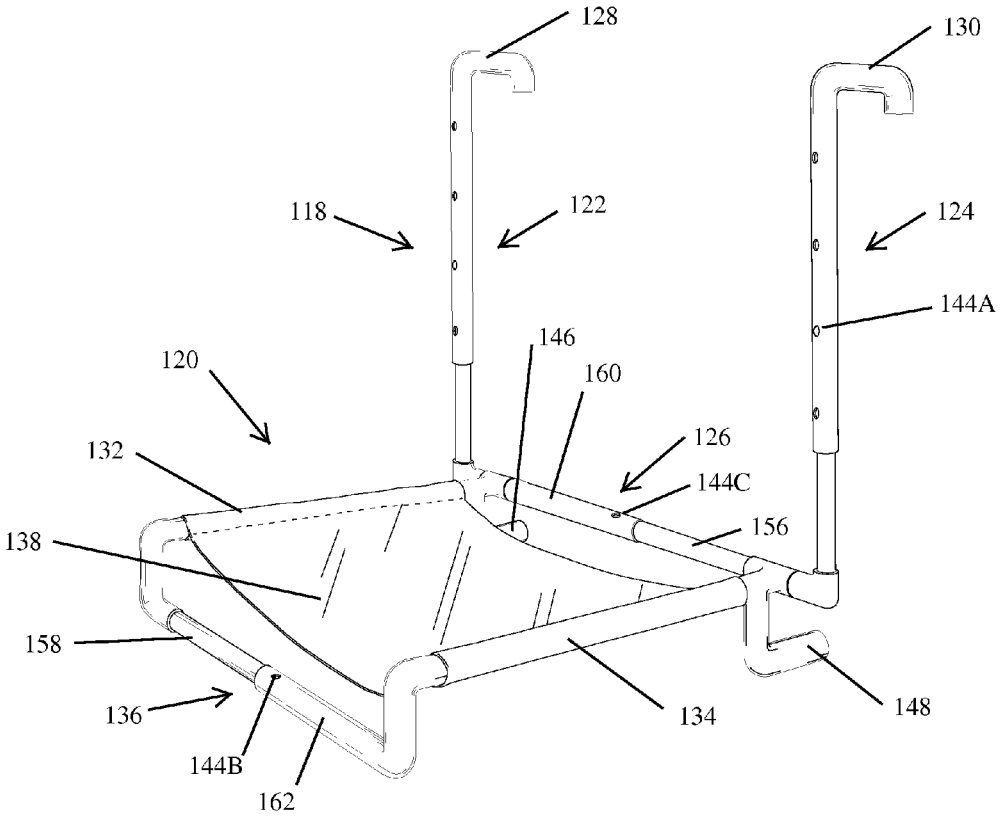
FIG. 2A is a perspective view of the version shown in FIG. 1.
Figure 2B:
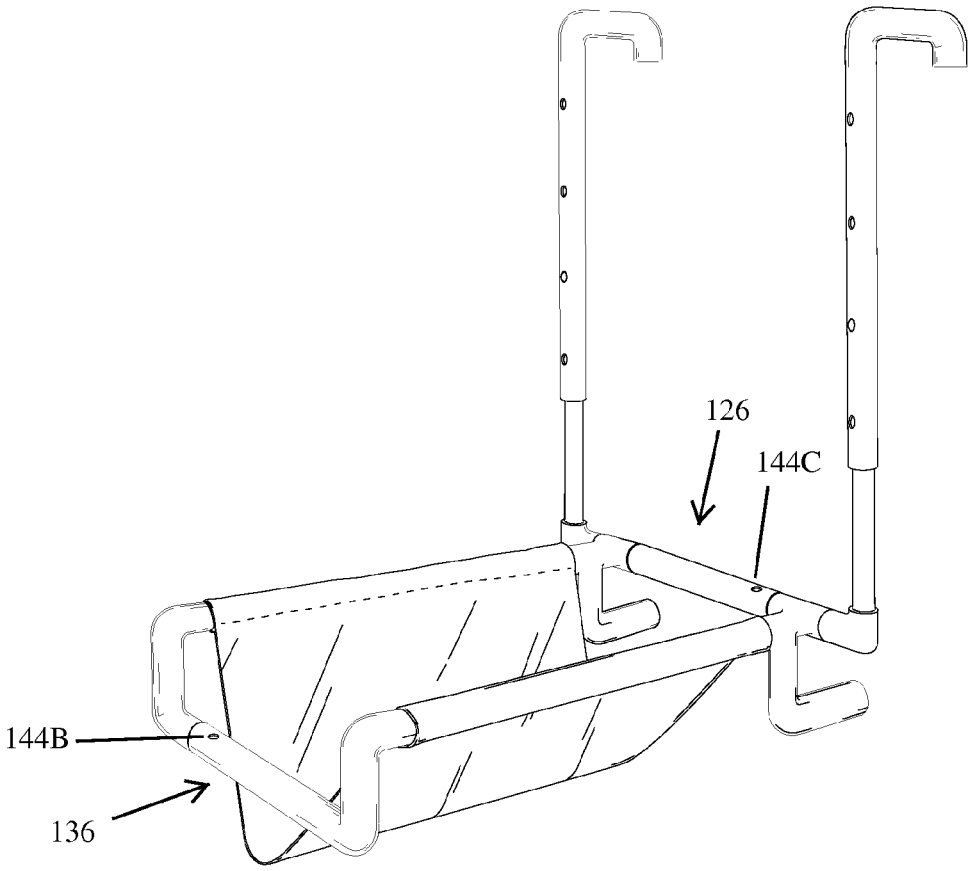
FIG. 2B is a partially collapsed chair width perspective view of the version shown in FIG. 1.
Figure 2C:
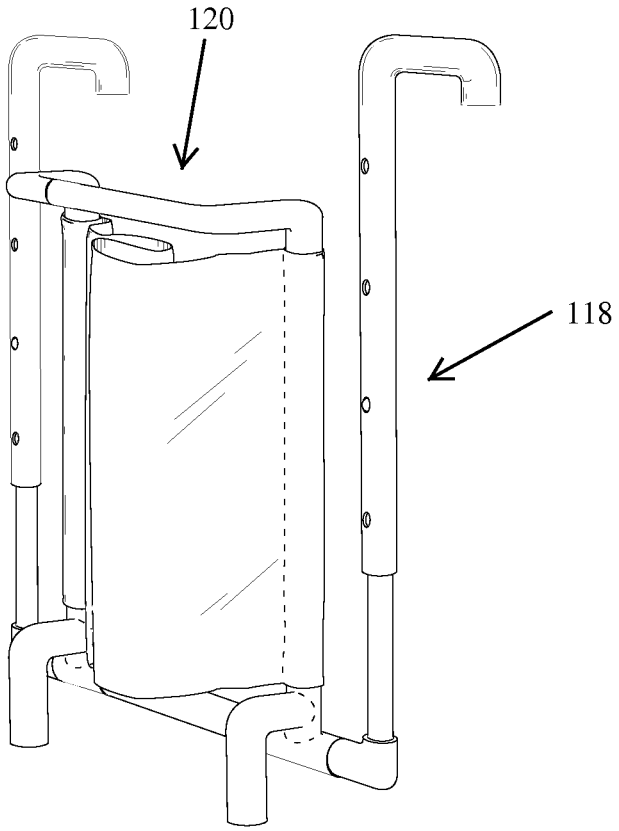
FIG. 2C is a seat assembly pivotally collapsed perspective view of the version shown in FIG. 1.
Figure 2D:
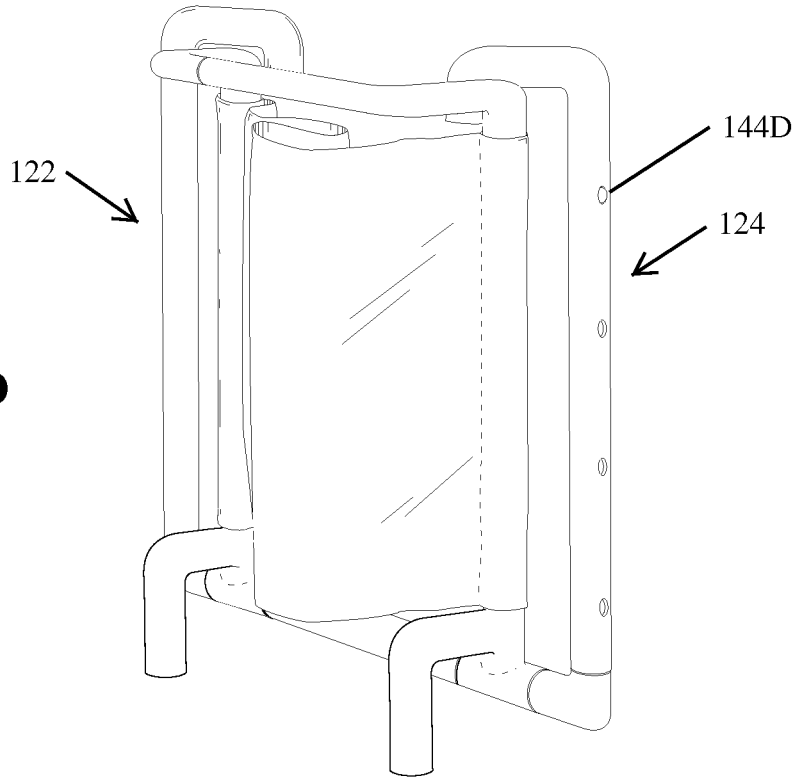
FIG. 2D is a fully collapsed perspective view of the version shown in FIG. 1.
Figure 3:
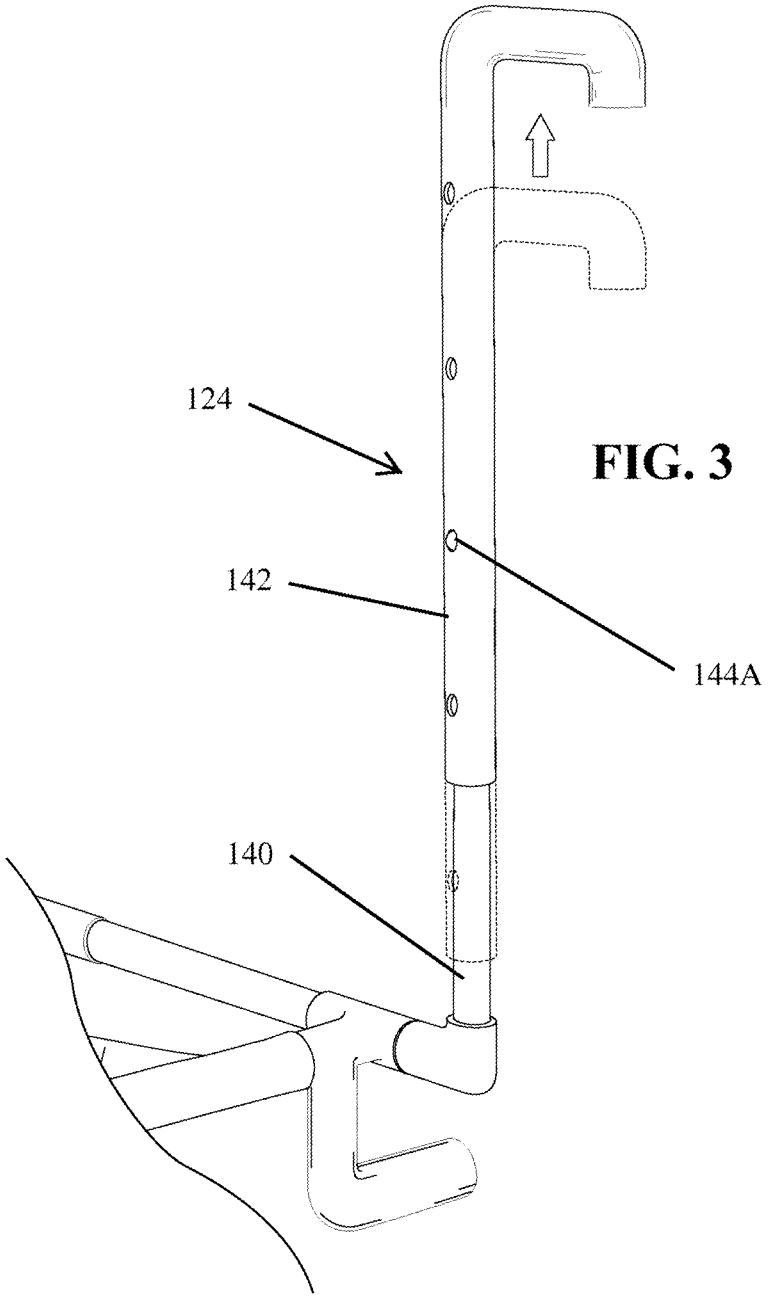
FIG. 3 is an up-close cut away view of the telescoping vertical support member of the version shown in FIG. 1.
Figure 4:
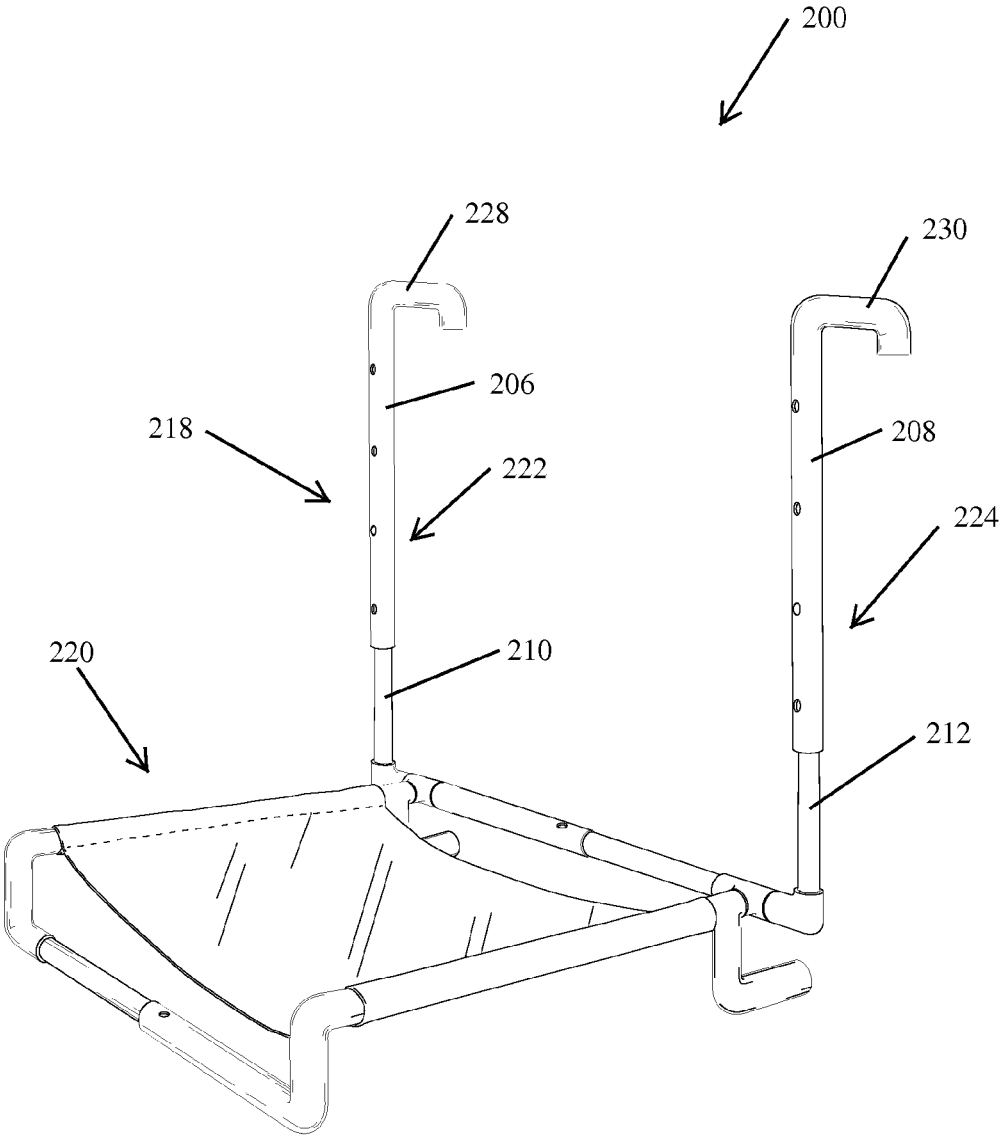
FIG. 4 is a perspective view of a second version of the present invention.

With reference now to the drawings, and in particular to FIG. 1 through FIG. 3 thereof, a new aquatic collapsible and portable pool chair apparatus embodying the principles and concepts of the present invention and generally designated by the reference numeral 100 will be disclosed.

FIG. 1 shows a perspective exemplary view the present invention attached to a pool wall 112 and pool deck 114. The pool chair apparatus 100 enables a user 116 to be immersed within the pool while sitting upright, with their upper body and head above the water level in a comfortable, upright stable position.

As best illustrated in FIGS. 1 through 4, the pool chair apparatus 100 generally comprises a pool wall attachment assembly 118 and a seat assembly 120. The seat assembly 120 is pivotally coupled with the pool wall attachment assembly 118. This allows the assemblies to collapse and fold up into a generally compact and parallel configuration for transport and storage as further defined below.

The pool wall attachment assembly has a pair of length-adjustable vertical support members 122 and 124 having top and bottom ends, a length-adjustable cross member 126 attaching the bottom ends of the length-adjustable vertical support members 122 and 124, and a pair of corresponding pool deck support hooks 128 and 130 attached near the top end of each length-adjustable vertical support member 122 and 124. As illustrated in FIG. 1, the pool wall attachment assembly 118 is positioned generally parallel to the pool wall 112. The pair of pool deck support hooks 128 and 130 are positioned and configured to engage with the pool deck 114 in a way that vertically supports the pool chair apparatus 100 by hanging on and gripping the pool deck 114.

The seat assembly comprises a pair of horizontal support members 132 and 134 with proximal and distal ends. The proximal ends of the horizontal support members 132 and 134 are pivotally coupled to the ends of the length-adjustable cross member 126. The seat assembly 120 further comprises a length-adjustable front cross member 136 connecting the front distal ends of the horizontal support members 132 and 134 forming a seat perimeter. A seat 138 is located within the seat assembly 120. The seat 138 is preferably made of a flexible, porous material and is attached between the horizontal support members 132 and 134. The seat can be made of an elastic material as well.

As illustrated by FIG. 3, The length-adjustable vertical support members 122 and 124 are made of a telescoping inner tubular member 140 and an outer tubular member 142, wherein the outer tube slides over the inner tubular member to the desired length. The length can be locked into place by a locking means 144A such as utilizing one or more embedded button clips.

Referring to FIG. 2A, the length-adjustable cross member 126 and the length-adjustable front cross member 136 comprise telescoping inner tubular members 156 and 158 and an outer tubular member 160 and 162, wherein the outer tube slides over the inner tube depending on the users desired width of the pool chair apparatus 100. The width can be locked into place by a locking means 144B and 144C such as one or more button clips. This enables a user to adjust the width to his or her body size and provides the ability to further collapse for transport and storage of the pool chair apparatus.

In the version depicted in FIGS. 2A and 2B, the length-adjustable cross member 126 and the length-adjustable front cross member 136 have two distinct position, an open position (FIG. 2A) wherein the length of the members are maximized for use of the chair and a closed position (FIG. 2B), wherein the length is minimized for transport and storage. Each position is locked into place by a locking means 144B and 144C such as one or more button clips.

The seat assembly further comprises a pair of wall contact support members 146 and 148 that are attached near the proximal end of each horizontal support member 132 and 134 for adapting to a pool wall 112. As illustrated in FIG. 1, the combined support of the pair of pool deck support hooks 128 and 130 and the wall contact supports 146 and 148 provide a secure fit to the wall while the pool chair apparatus 100 is in use.

The portability and the collapsibility of a version embodying the invention is shown in FIGS. 2A through 2D. FIG. 2A is an illustration of the version in the fully unfolded and ready for use position. The seat assembly 120 is pivoted downward in a generally perpendicular position with respect to the pool wall attachment assembly 118. The length-adjustable cross member 126 and length-adjustable front cross 136 members are fully extended and locked into place by button clips 144B and 144C. The length-adjustable vertical support members 122 and 124 are in the extended position and locked into place by a locking means 144A such as a button clip for a desired seat depth.

FIG. 2B is a partially collapsed width perspective view of the version. The length-adjustable cross member 126 and the length-adjustable front cross member 136 are fully collapsed with the outer tubular members fully encompassing the inner tubular members and optionally locked into place by a locking means 144B and 144C, such as a button clip.

FIG. 2C is a seat assembly pivotally collapsed perspective view of the version. The seat assembly 120 is pivoted up and substantially parallel with the pool wall attachment assembly 118, forming a substantially flat unit for transport and storage.

Further, FIG. 2D is a fully collapsed perspective view of the version. The length-adjustable vertical support members 122 and 124 are shown in the collapsed, downward position with the outer tubular members fully encompassing the inner tubular members and optionally locked into place via a locking means 144D such as one or more button clips. Thus, the pool chair is in a configuration that is excellent for easy transport and space saving storage, due to its reduced profile.

Figure 5:
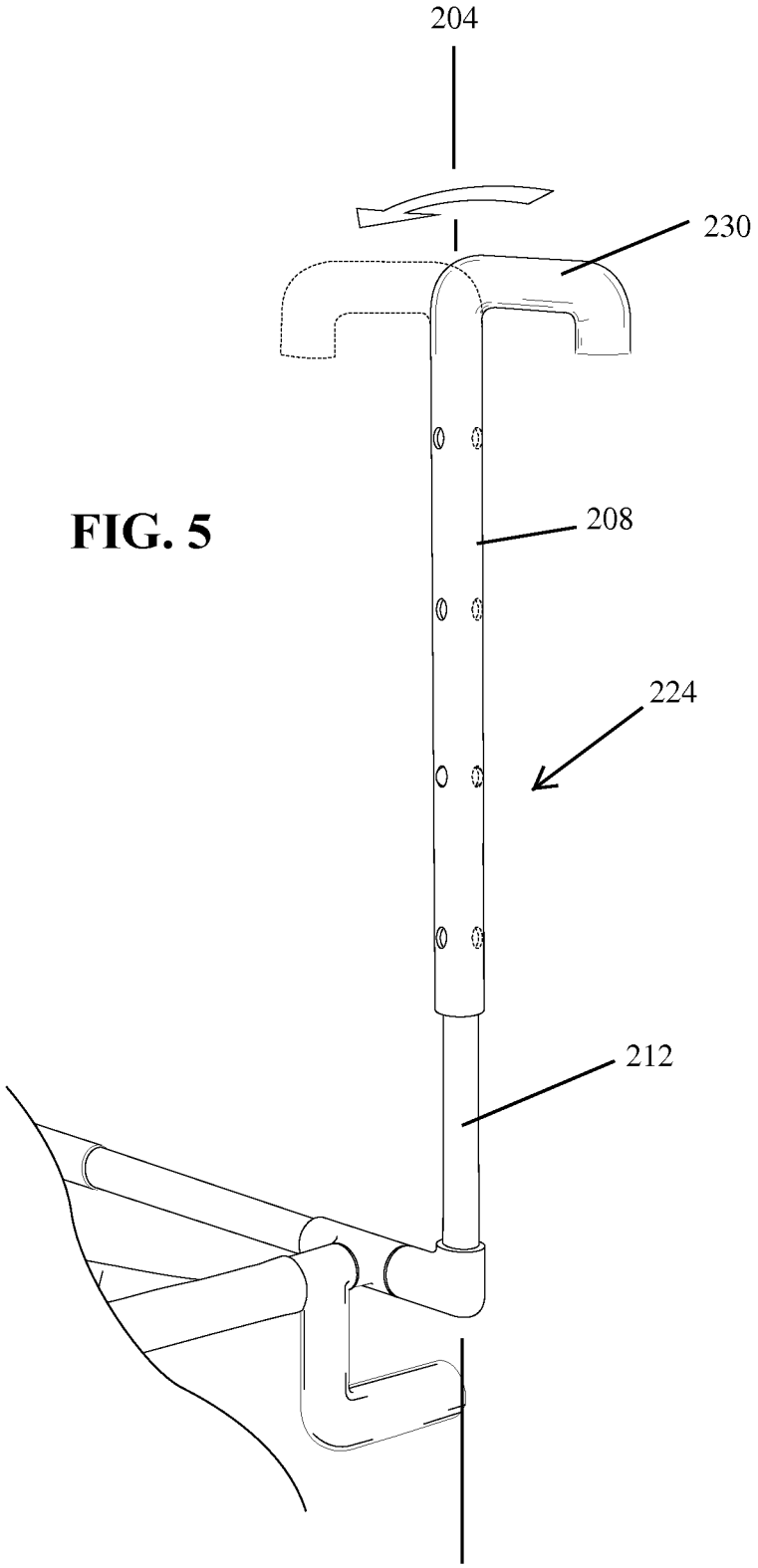
FIG. 5 is an up-close cut away view of the right side rotating pool deck support hook of the version shown in FIG. 4.
Figure 6:
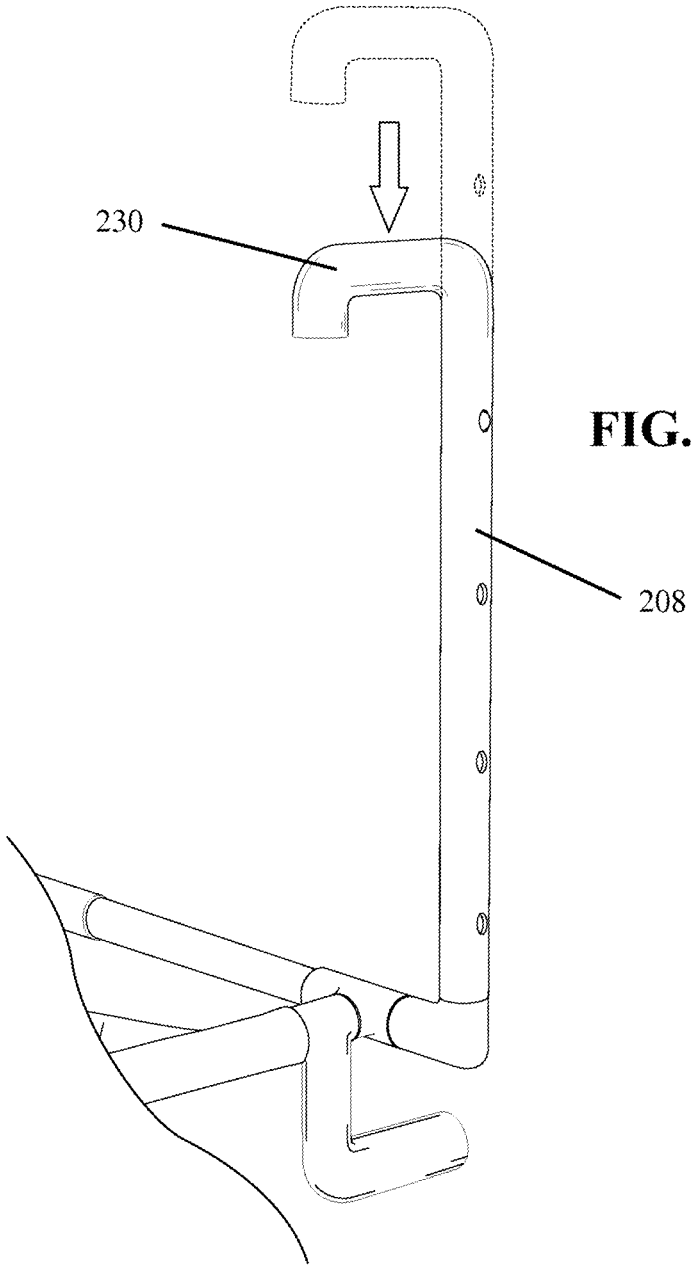
FIG. 6 is an up-close cut away view of the right side rotating pool deck support hook in the fully collapsed position of the version shown in FIG. 4.

A second version generally depicted as 200 embodying the invention is shown in FIGS. 4 through 7D, wherein the pool deck support hooks 228 and 230 are rotatable about the longitudinal axis 204 of the length-adjustable vertical support members 222 and 224 as depicted in FIG. 5. Ideally, the pool deck support hooks 228 and 230 and the outer tubular members 206 and 208 of the length-adjustable vertical support members 222 and 224 are rigidly connected to form single telescoping members that are rotatable about the longitudinal axis of the inner tubular members 210 and 212. As detailed in FIG. 4 and FIG. 5, this allows the pool deck support hooks 228 and 230 and the outer tubular members 206 and 208 to rotate inward when the pool chair is not in use, providing a further reduction in profile. FIG. 6 is an up-close, cut away view that depicts the combined inwardly rotated pool deck support hook 230 and outer tubular member 208 in the fully collapsed position, being securely locked into place via the locking means which is a button clip.

Figure 7A:
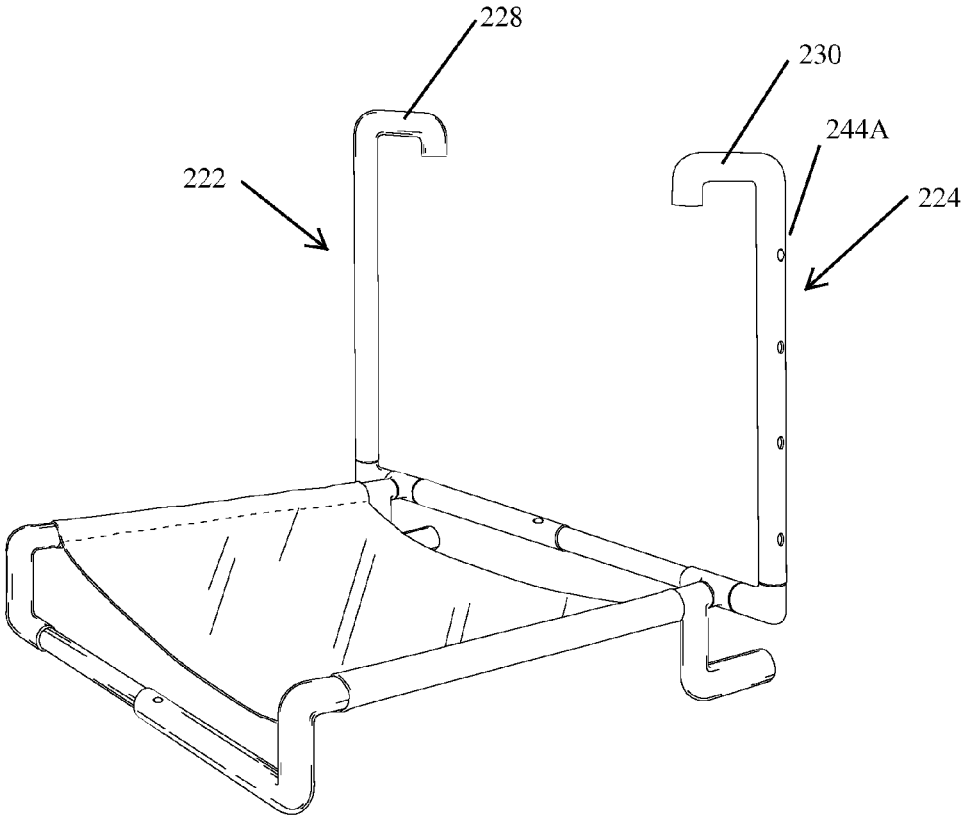
FIG. 7A is a perspective view with the vertical support members in the collapsed position of the version shown in FIG. 4.

FIG. 7A is a partially collapsed perspective view with the length-adjustable vertical support members 222 and 224 and pool deck support hooks 228 and 230 in the collapsed position as shown in detail in FIG. 6. Optionally, the vertical support members 222 and 224 can be locked into this position by a locking means 244A.

Figure 7B:
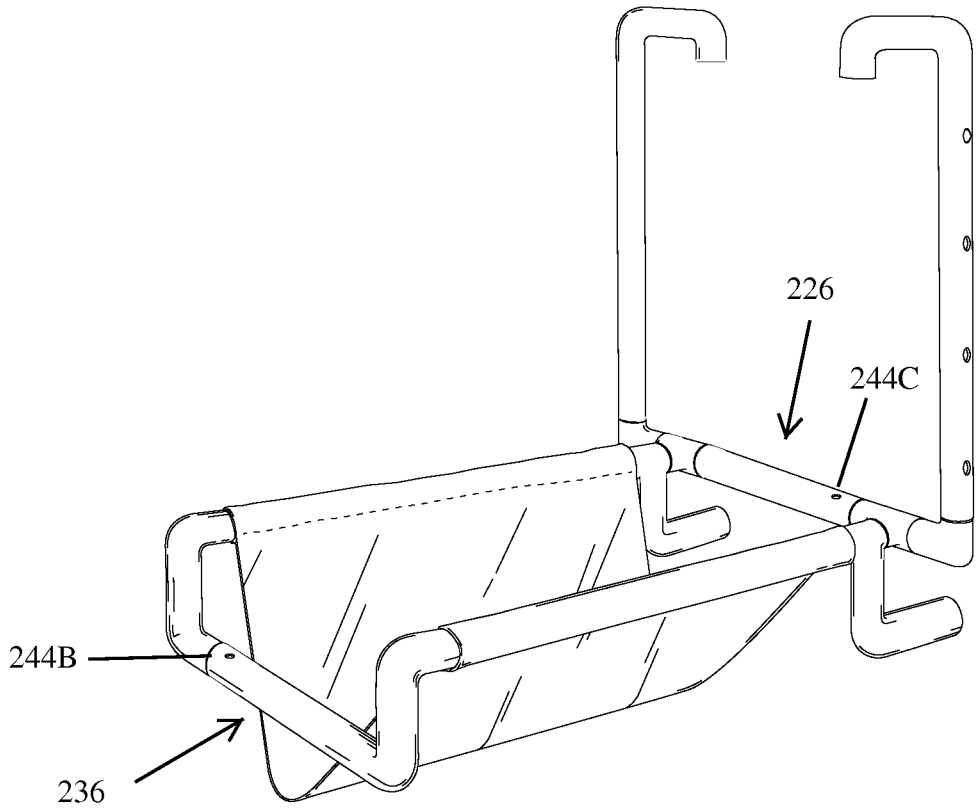
FIG. 7B is a partially collapsed chair width perspective view of the version shown in FIG. 4.

FIG. 7B is a partially collapsed width perspective view of the version. The length-adjustable cross member 226 and the length-adjustable front cross member 236 are fully collapsed with the outer tubular member fully encompassing the inner tubular members, and optionally locked into place by a locking means 244B and 244C such as a button clip.

Figure 7C:
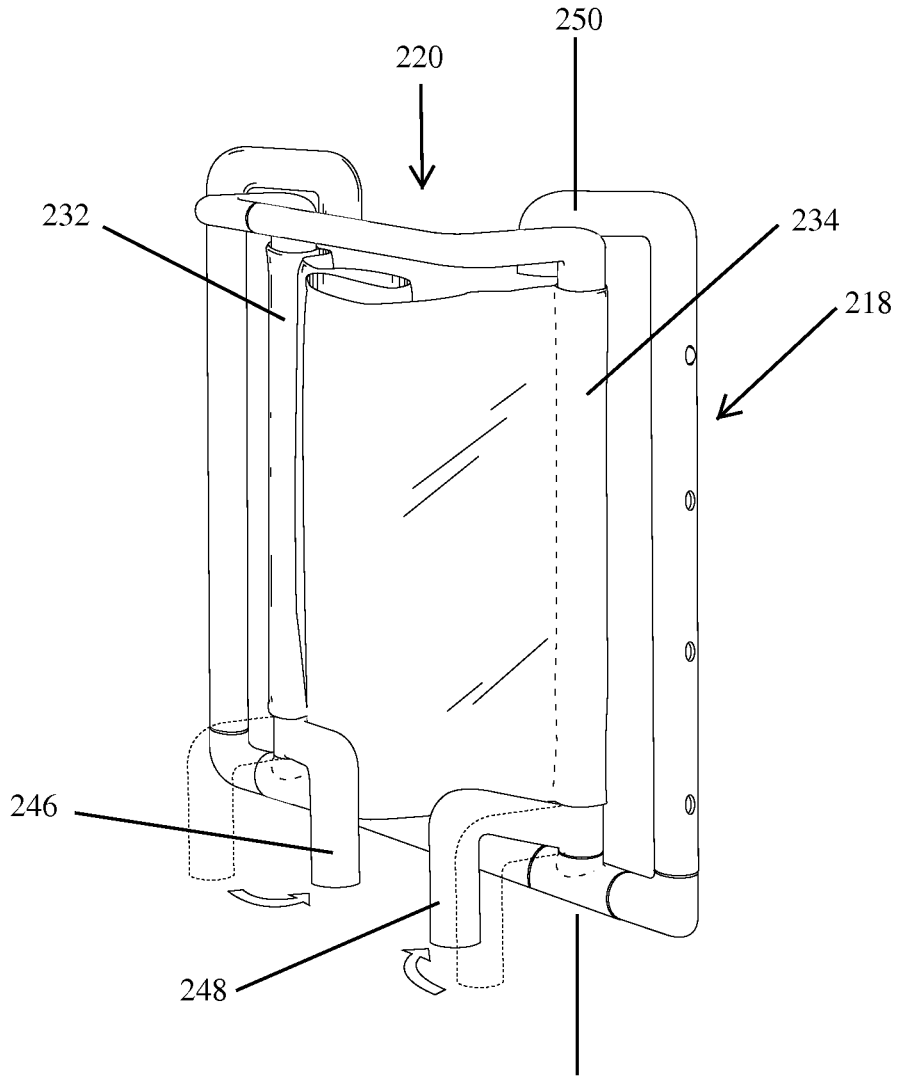
FIG. 7C is a partially collapsed perspective view of the version shown in FIG. 4.

FIG. 7C is a seat assembly pivoted collapsed perspective view of the version. The seat assembly 220, being pivotally connected to the pool wall attachment assembly 218, is pivoted up and into a parallel position with respect to the pool wall attachment assembly 218, forming a substantially flat unit for transport and storage.

FIG. 7C illustrates the ability to rotate the wall contact support members 246 and 248 about the longitudinal axis 250 of the horizontal support members 232 and 234. Ideally, the wall contacts support members 246 and 248 are rotated inward towards the center of the chair. This enables the collapsed pool chair to form a substantially flat profile for easy transport and storage.

Figure 7D:
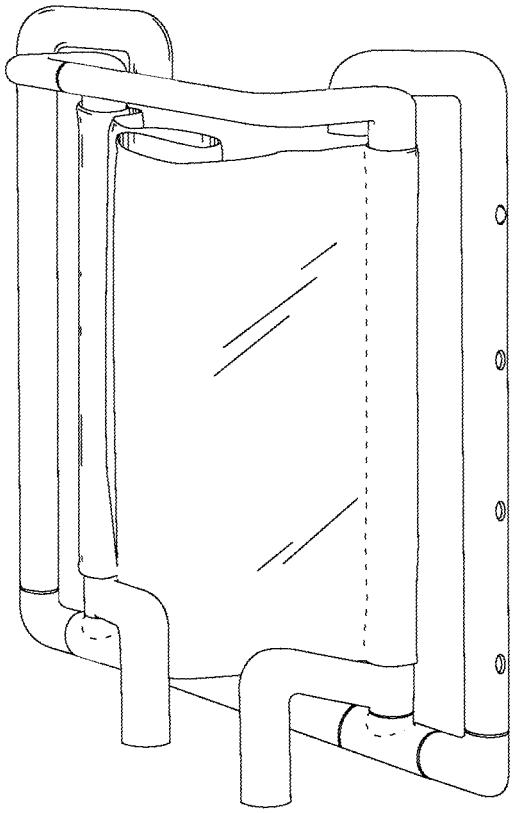
FIG. 7D is a fully collapsed perspective view of the version shown in FIG. 4.

Finally, FIG. 7D depicts the version of the pool chair in the fully collapsed transport and storage position.

The pool chair can be made adaptable to any size aquatic body and any size person.

The present invention can be made in any manner and of any material chosen with sound engineering judgment. Preferably, materials will be strong, lightweight, long lasting, economic, and ergonomic such as plastic piping or polyvinyl chloride piping (PVC).

The previously described versions of the present invention have many advantages, including providing an aquatic chair that utilizes an existing pool structure such as a pool wall that is simple, long lasting, durable, collapsible, and adjustable. These features make it easy to utilize, transport and store for all ages and abilities.

The invention does not require that all the advantageous features and all the advantages need to be incorporated into every version of the invention.

Although preferred versions of the invention have been described in considerable detail, other versions of the invention are possible.

All the features disclosed in this specification (including and accompanying claims, abstract, and drawings) may be replaced by alternative features serving the same, equivalent or similar purpose unless expressly stated otherwise. Thus, unless stated otherwise, each feature disclosed is one example only of a generic series of equivalent or similar features.

What is claimed is:

1. A collapsible portable pool chair adapted to be partially submerged by hanging in a pool adjacent a pool wall, comprising:

(a) a pool wall attachment assembly, comprising:

(i) a pair of length-adjustable vertical support members having top and bottom ends and a longitudinal axis, each vertical support member having an upper tube and a lower tube configured in a telescoping arrangement, the upper tube receiving therein at least a portion of the lower tube;

(ii) a length-adjustable cross member attaching bottom ends of the lower tubes of said vertical support members; and (iii) a pool deck support hook attached near the top end of each vertical support member upper tube for securing the chair to a pool deck; and (b) a seat assembly pivotally attached to the pool wall attachment assembly, the seat assembly comprising:

(i) a pair of spaced apart seat assembly couplings disposed along the length-adjustable cross member of the pool wall attachment assembly, the length-adjustable cross member passing through a portion of each seat assembly coupling such that the seat assembly couplings are rotatable about the length-adjustable cross member;

(ii) a length-adjustable front cross member;

(iii) a pair of horizontal support members with proximal and distal ends, the proximal ends of the horizontal support members attached to corresponding receiving portions of the seat assembly couplings while the distal ends of the horizontal support members are attached to the length-adjustable front cross member, thereby forming a seat perimeter and allowing the seat assembly to both collapse and fold up towards the pool wall attachment assembly;

(iv) a seat located within the seat perimeter; and (v) a wall contact support member associated with each horizontal support member and extending at least rearwardly for adapting to the pool wall;

wherein the upper tube is rotatable about the lower tube of the pool wall attachment assembly, and the wall contact support members are rotatable about the horizontal support members, such that the pool deck support hooks and wall contact support members are inwardly rotatable to provide a further reduction in profile when the chair is collapsed.

2. The collapsible portable pool chair of claim 1, wherein the seat is connected between the horizontal support members.

3. The collapsible portable pool chair of claim 2, wherein the seat is made of a flexible material.

4. The collapsible portable pool chair of claim 2, wherein the seat is made of an elastic material.

5. The collapsible portable pool chair of claim 1, wherein the distal end of each horizontal support member forms at least a portion of the length-adjustable front cross member.

6. The collapsible portable pool chair of claim 1, wherein the horizontal support members pass through a portion of the wall contact support members.

7. The collapsible portable pool chair of claim 1, wherein the length-adjustable vertical support members further comprise a locking means, and wherein a desired length of the vertical support members is lockable by the locking means.

8. The collapsible portable pool chair of claim 7, wherein the pool deck support hooks are an integrally formed portion of the upper tubes of the vertical support members.

9. The collapsible portable pool chair of claim 7, wherein the vertical support members are lockable by the locking means in both a support position and an inwardly-rotated position.

10. The collapsible portable pool chair of claim 1, wherein the length-adjustable cross member comprises a telescoping inner tubular member, outer tubular member, and a locking means, wherein the outer tubular member slides over the inner tubular member to form a desired length, and the desired length is lockable by the locking means; and wherein the length-adjustable front cross member comprises a telescoping inner tubular member, outer tubular member, and a locking means, the outer tubular member slides over the inner tubular member to form a desired length, and the desired length is lockable by the locking means.

11. The collapsible portable pool chair of claim 10, wherein the distal end of one of the pair of horizontal support members forms the outer tubular member of the length-adjustable front cross member.

* * * * *